US005133887A

United States Patent [19]

Terech et al.

[11] Patent Number: 5,133,887

[45] Date of Patent: Jul. 28, 1992

[54] PROCESS FOR THE SYNTHESIS OF GREASES PERMITTING A GOOD CONTROL OF THEIR MECHANICAL BEHAVIOUR AND GREASES THUS OBTAINED

[75] Inventors: Pierre Terech, Saint Egreve; Jean-Marie Thiebaux, Corbas; Pierre Sanvi, Vernaison; Charles Grubner, Sainte Foix l'Argentiere, all of France

[73] Assignee: Elf France, Courbevoie, France

[21] Appl. No.: 439,028

[22] PCT Filed: Feb. 22, 1989

[86] PCT No.: PCT/FR89/00067

§ 371 Date: Nov. 29, 1989

§ 102(e) Date: Nov. 29, 1989

[87] PCT Pub. No.: WO89/08139

PCT Pub. Date: Sep. 8, 1989

[30] Foreign Application Priority Data

Feb. 24, 1988 [FR] France ..... 88 02205

[51] Int. Cl.[5] ..... C10M 141/00

[52] U.S. Cl. ..... 252/33.2; 252/35; 252/38; 252/39; 252/41

[58] Field of Search ..... 252/33.2, 38, 35, 39, 252/41

[56] References Cited

U.S. PATENT DOCUMENTS

| | | | |
|---|---|---|---|
| 2,456,642 | 12/1948 | Merker | 252/32 |
| 2,892,777 | 6/1959 | Morway | 252/32 |
| 3,158,574 | 11/1964 | Greenwood et al. | 252/36 |
| 3,242,079 | 3/1966 | McMillen | 252/33 |

FOREIGN PATENT DOCUMENTS

| | | |
|---|---|---|
| 648763 | 1/1951 | United Kingdom . |
| 758493 | 10/1956 | United Kingdom . |
| 1508281 | 4/1978 | United Kingdom . |

*Primary Examiner*—Prince Willis, Jr.
*Assistant Examiner*—Jerry D. Johnson
*Attorney, Agent, or Firm*—Burgess, Ryan & Wayne

[57] ABSTRACT

Method for synthesizing greases by adding at least one co-surfactant to the mixture of the thickener in the oil. The addition is made at the initial stage of the formation of a three-dimensional filamentary network of the grease at a temperature between the waxy transition temperature and the melting point of the thickener. The process permits good control of the mechanical behaviour of the greases.

16 Claims, No Drawings

PROCESS FOR THE SYNTHESIS OF GREASES PERMITTING A GOOD CONTROL OF THEIR MECHANICAL BEHAVIOUR AND GREASES THUS OBTAINED

BACKGROUND OF THE INVENTION (1) Field of the Invention

This invention relates to a process for the synthesis of greases permitting a good control of their mechanical behaviour.

(2) Description of the Related Art

Greases are colloidal systems made up of a three- o dimensional network of thickening molecules in an oil.

The thickeners employed to form this network may be, for example, metal soaps, by themselves or mixed with polymers.

The oil belongs to the class of lubricating oils. This oil is trapped and kept within the three-dimensional network of the thickener by a combination of capilliary, adsorption and steric interaction forces.

Greases are widely employed for lubricating rotating mechanical components, in fields as diverse as domestic appliances, motor vehicles or aviation. They have the advantage of a great ease of application and of a reduced maintenance.

The properties of greases can be improved by the use of additives. It is thus possible to improve the resistance to oxidation, to wear and to corrosion by the addition of amine salts, of metal sulphates, of naphthenates, of esters and of nonionic surfactants to the greases.

The extreme-pressure properties can be improved by the addition of graphite, molybdenum disulphide, zinc oxide or talc.

It is also known to modify the mechanical properties of greases by varying the proportion of metal soap and the heat treatment during their process of manufacture.

The conditions of use of greases frequently call for contradictory properties. Thus, for a given consistency and mechanical working strength it is sometimes advantageous to have increased adhesion and/or fluidity properties. Currently known means do not allow this problem to be solved.

We have now found a process which, on the one hand, permits a good control of the mechanical behaviour of greases and, on the other hand, makes it possible to modify the contradictory mechanical properties in a continuous way.

SUMMARY OF THE INVENTION

This process for the synthesis of greases consists in the addition of at least one cosurfactant to the mixture of the thickener in the oil, characterized in that the addition of the said cosurfactant is carried out already at the initial stage of the formation of the three-dimensional filamentary network of the grease.

DETAILED DESCRIPTION OF THE INVENTION

This three-dimensional network is formed when the temperature of the mixture of thickener, oil and cosurfactant is between the waxy transition and melting temperatures of the thickener.

The waxy transition temperature is defined as being the first stage of structural disorganization which the crystalline solid undergoes when the temperature is increased (M. J. Vold et al., J. Colloid Sci., 5, 1(1950) and R. M. Suggitt NLGI Meeting XXIV, 9, 367 (1960)).

When the cosurfactant is introduced at the initial stage of the formation of the three-dimensional network of the thickener, the cosurfactant and the thickener are in structural competition. The incorporation of the cosurfactant into the network allows the mechanical behaviour of the grease to be controlled.

The oil employed for the manufacture of greases is a lubricating oil of natural origin, such as paraffinic and naphthenic oils or elsé a synthetic oil. Diesters, alpha-olefin polymers and silicone oils may be mentioned among the synthetic oils.

The thickeners which form part of the composition of greases are in most cases metal soaps. Fatty acids are preferably employed, in the form of a lithium, sodium, calcium, barium or aluminium salt. Lithium salts are the most commonly employed, and more particularly the lithium salt of 12-hydroxystearic acid.

In this case, for example, the waxy transition temperature is 163° C., while the melting temperature is 215° C.

The cosurfactant may be chosen from alcohols, amines, carboxylic and sulphonic acids and their alkali metal and alkaline-earth metal salts.

The alcohols, amines and carboxylic acids are generally employed in a free form, while sulphonic acids are employed in the form of alkali metal sulphates.

The hydrocarbon part of the cosurfactants is generally aliphatic or alicyclic in structure.

The aliphatic chain must contain at least 4 carbon atoms. Cosurfactants whose chain contains between 4 and 18 atoms, and preferably between 8 and 12 carbon atoms in the main chain are generally employed. Since steric hindrance is an important characteristic of cosurfactants, the aliphatic chain must be linear or relatively unbranched.

Cyclohexane derivatives (cyclohexanol, cyclohexanecarboxylic acid) are particularly suitable among the alicyclic derivatives. The cyclohexane nucleus may be substituted by an aliphatic chain from $C_1$ to approximately $C_{12}$.

Among the cosurfactants of the sulphate type, sodium dodecyl sulphate is particularly suitable because of its low vapour pressure at the usual temperatures of preparation of greases. What is more, this product, employed as a dispersing agent, is widely available and its cost of manufacture is compatible with this use.

However, if the grease must be employed in contact with water, it is preferable to employ cyclohexanecarboxylic acid and its derivatives as a cosurfactant.

The stoichiometric ratio of the thickener to the cosurfactant forming part of the grease composition is a function of the effectiveness of the cosurfactant employed. The latter is linked with the ability of the cosurfactant to dissolve or to form micelles from the filamentary structures of the soap aggregates.

This property can be assessed by measuring the apparent decrease in viscosity at a given shear rate (for example 5 $s^{-1}$) with increasing cosurfactant contents.

Our greases are characterized by means of the thickener/cosurfactant stoichiometric ratio (K). The value of the ratio (K) is fixed according to the magnitude of the desired effects on the mechanical properties of greases, such as working strength, apparent viscosity, thixotropy and adhesiveness. The ratio (K) is a function of the nature of the system investigated and characterizes the effectiveness of the cosurfactant for a given thickener-/oil pair.

The value of (K) is generally between 4 and 10.

For very low values of (K) of around 2, the tendency is towards the mechanical behaviour of newtonian liquids. For very high values of (K), ≧ 12, the repercussion on the mechanical properties is not appreciable.

In the case of the use of sodium dodecyl sulphate as a cosurfactant and of a metal soap thickener (Li, Na, Ca, Ba, Mg or Al stearate or hydroxystearate) the ratio (K) is preferably around 6. Under these conditions, the viscosity drops by a factor of 2, while the modifications of the mechanical properties are detailed in the examples, where the ratio (K) is 6.1.

We shall call "cosurfacted" greases the greases whose three-dimensional network includes thickener molecules and cosurfactant molecules.

Cosurfacted greases are obtained by incorporating thickener, generally a soap, and cosurfactant into the oil at a temperature between the waxy transition and the melting temperatures of the thickener. The mixture, homogenized by stirring, is subjected to the heat treatment chosen for the preparation of the grease. In the example described, this treatment consists of a rapid cooling of the liquid mixture from the melting temperature of the thickener (215° C.) to ambient temperature.

To widen the range of mechanical properties, cosurfacted greases may be mixed with single greases. We shall call these mixtures "mixed greases".

We have carried out many measurements to characterize these cosurfacted and mixed greases and to compare their mechanical behaviour with a single grease. One of the first measurements assesses the consistency of the grease at 25° C. by determining the "cone penetration" according to the standards AFNOR NF.T.60,132 and ASTM D 217.

This determination consists in measuring the penetration, in $10^{-4}$m, of a standardized cone over 5 seconds into the grease maintained at 25° C.

This measurement is performed either on "virgin" grease (unworked penetration: UWP), or on grease which has undergone a specified mechanical work (so-called worked penetration). This work consists in moving a perforated plunger within the grease at a rate of 60 return strokes in 60 seconds, in a standard apparatus called a worker ($P_{60}$).

To evaluate the mechanical working strength of the grease, the grease may be "worked" 100,000 strokes in the worker. After this work, the penetration ($P_{10}5$) is determined as before, according to the standards AFNOR NF.T.60,132 and ASTM D 217.

The thixotropy (T) is expressed in arbitrary units as the surface area of the stress-shear gradient rheograms between 100 and 1,000 $s^{-1}$, which are determined using a Contraves Rheomat 135 cone-and- plate viscometer.

The apparent viscosity at 20° C. is measured at shear gradients of 5 and 1,000 $s^{-1}$ in the same Contraves Rheomat 135 apparatus.

Adhesiveness is evaluated by measuring the quantity of grease remaining on a rotating cylindrical drum. This expresses a mass percentage of grease adhering to the drum in the case of a centrifugal force equivalent to 475 g applied for 300 s.

This test has been developed in the ELF France laboratories at Solaize.

The greases obtained according to the present invention exhibit a particular working strength.

The analyses carried out make it possible to ascertain 3 types of mechanical behaviour, which are specific and which constitute the advantage of the invention:

1) Usually, worked greases soften in proportions which are given by the difference in penetration $=P_{10}5-P_{60}$ for the single, so-called reference grease (see Example 1, Tables I and II). Now, if greases which have the same soap content overall are compared, it is found that this difference can be divided by at least 2 (Example 6) or even reversed (Example 2).

This latter situation is remarkable and corresponds to a grease whose consistency does not deteriorate or even improves as a function of the working time.

2) The thickener/cosurfactant stoichiometric ratio K allows the thixotropy of the greases to be modified. It is thus even possible to manufacture nonthixotropic greases, in the case of which no hysteresis is measured in the stress-shear gradient rheograms (Example 6).

3) While the cosurfactant greases are less adhesive than the single greases at the same soap content (Examples 1 and 2, Table II), they are nevertheless as adhesive as the single greases of the same consistency, defined by $P_{60}$ (Examples 4 and 1, Table II). Example 3 shows that the adhesiveness can even be greatly improved, for a soap content adapted to a given K. Table II clearly shows the existence of an adhesiveness-thixotropy correlation: the greases which are particularly adhesive are also thixotropic (Example 3). This correlation can be completely controlled by means of the absolute soap content and the soap/cosurfactant ratio K.

These results are obtained in the case of an adapted thickener/cosurfactant ratio K. All the intermediate results can be obtained by varying this ratio, or the dilution operating method employed to obtain the final soap content of the grease. It is thus not equivalent to start from a high soap content and to dilute the cosurfactant system (Example 2) or to consider the system cosurfacted directly to the desired thickener content (Example 1).

EXAMPLES

To ensure a greater reproducibility of the examples, a simplified operating method is employed to prepare the greases. We describe the general conditions of preparation of our samples. These samples, whose total mass including the oil, the thickener and the cosurfactant is 1,000 g, are prepared from lithium 12-hydroxystearate (purity: 85%). The soap is dispersed in a type 750 Pale oil by mechanical stirring.

The temperature of the mixture is raised to 215° C., where the soap is completely melted. The adapted quantity of the cosurfactant sodium dodecyl sulphate (SDS) is added with stirring. Once the homogeneous mixture is melted, the reactor is quickly cooled to ambient temperature (6° C. $min^{-1}$) while mechanical stirring is maintained. The cooled grease is homogenized by milling and is then maintained at 25° C. before being subjected to the tests mentioned in Tables I and II. The introduction of the cosurfactant (SDS) already at the initial stage of the preparation at ambient temperature brings only a few modifications in the case of the thermal process described here.

EXAMPLE 1 (Comparative)

900 g of oil and 100 g of soap are heated to 220° C. according to the general conditions described above.

EXAMPLE 2

15.6 g of SDS cosurfactant are added to 884.4 g of oil and 100 g of soap according to the general operating procedure.

EXAMPLE 3

22.5 g of SDS are added to 833.5 g of oil and 144 g of soap according to the general operating procedure.

EXAMPLE 4

31.2 g of SDS are added to 768.8 g of oil and 200 g of soap according to the general operating procedure.

EXAMPLE 5

29.2 g of SDS are added to 783.8 g of oil and 187 g of soap according to the general operating procedure.

EXAMPLE 6

500 g of the sample obtained in Example 5 are mixed with stirring with 500 g of oil at ambient temperature and are then milled according to the general operating procedure.

EXAMPLE 7

500 g of the sample obtained in Example 1 are mixed with stirring with 500 g of the sample obtained in Example 5, at 50° C., and are then milled according to the general operating procedure.

Example 1 forms the reference sample, called single grease, which contains no cosurfactant. The cosurfacted greases employ sodium dodecyl sulphate in a thickener/cosurfactant stoichiometric ratio = 6.1.

Example 2 has the same soap content as the single reference grease.

Example 6 has the same final soap content as the single reference grease, but obtained by dilution in oil of a cosurfacted grease whose soap content is twice that of Example 5.

Example 3 shows a grease with a cone penetration comparable with that of the single reference grease.

Example 7 is that of a mixed grease which has the same soap content as Example 3, but a penetration comparable with that of the single reference grease. This grease is obtained by a 1:1 mass mixing of the single reference grease (Example 1) with a cosurfacted grease of the same penetration (Example 4).

Table I shows the soap content and the cone penetrations (P) unworked, worked 60 strokes, and worked $10^5$ strokes, as defined above.

TABLE I

| | soap (%) | Cosurfactant (%) | $P_{NW}$ | $P_{60}$ | $P_{10^5}$ |
|---|---|---|---|---|---|
| Example 1 | 10.0 | 0 | 230 | 228 | 304 |
| Example 2 | 10.0 | 1.56 | 300 | 303 | 287 |
| Example 3 | 14.4 | 2.25 | 237 | 241 | 223 |
| Example 4 | 18.7 | 3.12 | 226 | 231 | 239 |
| Example 5 | 20.0 | 2.92 | 189 | 199 | |
| Example 6 | 10.0 | 1.46 | 306 | 304 | 335 |
| Example 7 | 14.4 | 1.46 | 226 | 220 | 272 |

Table II details the mechanical behaviour of the greases referred to above. The working strength, the apparent viscosity for two shear rates, the thixotropy and the adhesiveness are measured according to the methods referred to already.

TABLE II

| | $P_{10^5}-P_{60}$ ($10^{-4}$ m) | ($5\ s^{-1}$) (Pa s) | ($1000\ s^{-1}$) (Pa s) | T (a.u.) | Adhesiveness |
|---|---|---|---|---|---|
| EX. 1 | +76 | 207 | 3.1 | 138 | 74.6 |
| EX. 2 | −16 | 172 | 1.8 | 48 | 32.8 |
| EX. 3 | −18 | 333 | 1.4 | 345 | 94.0 |
| EX. 4 | +8 | 272 | 3.2 | 132 | 77.3 |
| EX. 5 | +31 | 55 | 1.8 | 0 | 10.0 |
| EX. 6 | +52 | 209 | 1.9 | 68 | 55.9 |

We claim:

1. Process for the synthesis of greases by addition of at least one cosurfactant selected from the group consisting of aliphatic and alicyclic, amines, and carboxylic acids and alkali metal sulfates, wherein the aliphatic structure of said cosurfactant contains at least 4 carbon atoms, to a mixture of a thickener selected from metal soaps of fatty acids in an oil, wherein the stoichiometric ratio of the thickener/surfactant is from 4 to 10, wherein the addition of said cosurfactant is carried out at the initial stage of the formation of the 2-dimensional filamentary network of the grease and is added in an amount of from 1.56 to 3.12 weight percent and at a temperature between the waxy transition and the melting temperatures of the thickener.

2. Process according to claim 1, wherein the aliphatic structure contains a $C_8$–$C_{12}$ main chain.

3. Process according to claim 1, wherein the aliphatic structure contains a $C_4$–$C_{18}$ main chain.

4. Process according to claim 1, wherein the alicyclic structure is cyclohexane.

5. Process according to claim 4, wherein the cyclohexane nucleus is substituted by at least one aliphatic chain from $C_1$ to approximately $C_{12}$.

6. Process according to claim 1 wherein the cosurfactant is selected from the group consisting of sodium dodecyl sulphate and cyclohexanecarboxylic acid.

7. Process according to claim 1 wherein the oil is a lubricating oil of natural origin.

8. Process according to claim 7 wherein the oil is a paraffinic oil.

9. Process according to claim 7 wherein the oil is a naphthenic oil.

10. Process according to claim 1 wherein the metal soap is selected from the group consisting of lithium, sodium, calcium, barium, magnesium or aluminium salt of a fatty acid.

11. Process according to claim 10 wherein the metal soap is the lithium salt of 12-hydroxystearic acid.

12. A grease prepared by the addition of at least one cosurfactant selected from the group consisting of aliphatic and alicyclic amines, and carboxylic acids and alkali metal sulfates, wherein the aliphatic structure of said cosurfactant contains at least 4 carbon atoms, to a mixture of a thickener selected from metal soaps of fatty acids in an oil, wherein the stoichiometric ratio of the thickener/surfactant is from 4 to 10, wherein the addition of said cosurfactant is carried out at the initial stage of the formation of the 3-dimensional filamentary network of the grease and is added in an amount of from 1.56 to 3.12 weight percent and at a temperature between the waxy transition and the melting temperatures of the thickener.

13. Grease according to claim 12, wherein it also contains an additional grease.

14. Process for the synthesis of greases by addition of at least one cosurfactant selected from the group consisting of aliphatic and alicyclic amines, and carboxylic acids and alkali metal sulfates, wherein the aliphatic structure of said cosurfactant contains at least 4 carbon atoms, to a mixture of a thickener selected from metal soaps of fatty acids in a synthetic lubricating oil, wherein the stoichiometric ratio of the thickener/surfactant is from 4 to 10, wherein the addition of said cosurfactant is carried out at the initial stage of the formation of the 3-dimensional filamentary network of the grease and is added in an amount of from 1.56 to 3.12 weight percent and at a temperature between the waxy transition and the melting temperatures of the thickener.

15. Process according to claim 11 wherein the oil is an alpha-olefin polymer.

16. Process according to claim 11 wherein the oil is a silicone.

* * * * *